United States Patent [19]

Gillatt

[11] Patent Number: 4,975,070

[45] Date of Patent: Dec. 4, 1990

[54] WIRING SYSTEMS

[76] Inventor: Philip Gillatt, 67 Hamble, Belgrave, Tamworth, Staffordshire, B77 2JF, England

[21] Appl. No.: 365,238

[22] Filed: Jun. 12, 1989

[51] Int. Cl.[5] ..... H01R 25/14

[52] U.S. Cl. ..... 439/110; 439/209; 439/216

[58] Field of Search ..... 439/110, 117, 111, 208, 439/209, 216

[56] References Cited

U.S. PATENT DOCUMENTS

| | | | |
|---|---|---|---|
| 1,879,198 | 9/1932 | Gries | 439/216 |
| 2,190,196 | 2/1940 | Semenyna | 439/216 |
| 2,331,654 | 10/1943 | Butler | 439/111 |
| 3,668,601 | 6/1972 | McFarlin | 439/110 |

FOREIGN PATENT DOCUMENTS

| | | | |
|---|---|---|---|
| 516932 | 11/1959 | Belgium | 439/110 |
| 1503562 | 10/1967 | France | 439/209 |
| 541718 | 12/1941 | United Kingdom | 439/209 |

*Primary Examiner*—Eugene F. Desmond
*Attorney, Agent, or Firm*—Learman & McCulloch

[57] ABSTRACT

A low voltage electrical system uses a main comprising an extruded insulator with a pair of channels locating metal conductors which can be installed in the channels by passing them laterally through continuously extending slots opening to a face of the extrusion from the channels. Branch conductors with plugs on their ends can be engaged in contact with the conductors by pushing their prongs through the same slots. Resilience of the extruded insulator possibly aided by deformation of the cross section in installation ensures that the slots remain closed between plugs.

9 Claims, 3 Drawing Sheets

WIRING SYSTEMS

This invention relates to wiring systems for caravans, boats, portable buildings and the like. The conventional system for this purpose comprises a harness made up of lengths of insulated twin-core cable cut to length, with bared ends joined into terminal and junction assemblies. Each harness is pre-assembled for a specific installation so as to provide a trunk or main with a number of branches at the required spacings where lighting points or other electrical outlets are required. A different harness is needed for each caravan or building etc, and subsequent alterations to the electrical installation within that caravan or building needing harness changes are difficult or impossible. In short the known system is inflexible. The object of the invention is to provide improvements.

According to one aspect of the invention, a wiring system comprises an insulator strip or body formed with a pair of generally parallel longitudinally extending channels which can open to one or more faces of the strip and bare conductor wires located in said channels to provide an electric main, together with a plurality of outlets from the main each outlet comprising a pair of conductive prongs insulated one from the other for insertion into the channels to contact the conductor therein.

Preferably the insulator strip is of somewhat triangular cross-section and has a pair of faces generally at right angles to one another so that it can be laid in and along a corner as for example one edge of a floor, or up a corner between walls, or along the ceiling or roof/-wall intersection, in an inconspicuous manner.

The strip may be extruded from a suitable insulating material which is preferably of yielding and resilient nature, such as a synthetic plastics material or a rubber, with the channels provided in the extrusion process. The said pair of faces may be provided with a contact adhesive to facilitate location and fixing.

The said third face of the strip constitutes the hypotenuse of the triangular body and may be flat or concave and the two channels may open to the third face.

According to a feature of the invention, the strip is made of a shape to deform when installed and the deformation applies closing pressure to the slots. For example, the strip may be provided with divergent wing like portions which extend beyond the respective end faces and which when deflected in one direction from a normal position tend to close the slots opening from the channels, or apply greater pressure to hold those slots closed.

Insertion of wires, in assembly, may be achieved, according to a further aspect of the invention, by flexing the strip transversely in the opposite direction by means of the wings from the normal position to the deflection mentioned above so as to open the slots. Preferably the wire is of arcuate, concave/convex, cross-section but slightly smaller in one dimension than the channel so that the connecting prongs can be inserted between the wire and the channel wall and be gripped-in position, aided by the flexibility and resilience of the insulating material.

It will be appreciated that the flexible strip can be readily laid around corners of large radius, and for particularly small radius corners or abrupt bends the strip can be bent with tools.

The main may be laid so as to extend around substantially the whole of the periphery of the floor and/or ceiling of the room space provided by the caravan or the like and then electrical outlets can be inserted at any desired point along the entire length of the main.

The branch connections providing or leading to the outlet comprise (as mentioned) prongs which are preferably of resilient metal strip having free (bared) end portions. They can be forced into the channels through the gaps, after the conductors have been assembled in place, and passed between the conductor and the channel wall so as to be held in location by the strip. A securing screw may be used for added rigidity of the connection.

Each prong is integral with, or electrically connected to, a conductor extending along the length of the outlet fitting or branch. The two prong connected conductors may be assembled in the branch and the branch may be constructed in generally the same way as the main: alternatively and preferably the conductors in the branch may be surrounded by the insulation as by moulding it about them.

It will be appreciated that by these means a branch outlet can be connected to the main at any point along its length, and additional branch outlets can be provided as and where required without requiring substantial rewiring of the caravan or the like as was necessary with the previously known systems.

An embodiment of the invention is more particularly described with reference to the accompanying drawings wherein:-

Figure 1:
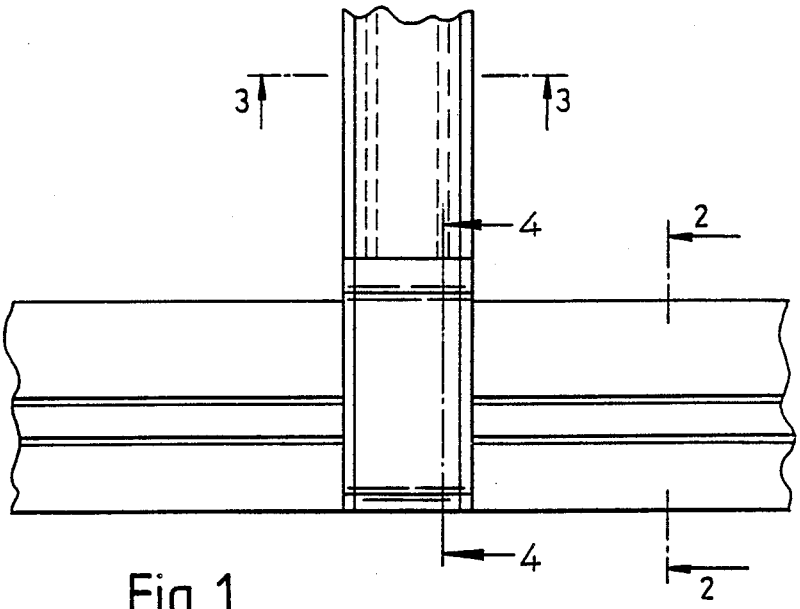
FIG. 1 is an elevation showing a fragmentary length of electric main with a single outlet assembled thereto.

Turning now to the drawings, the electric main comprises an extrusion 10 for example made of a semi-rigid PVC material, which it will be understood nevertheless possesses a certain resilience, which is generally of triangular shape having a pair of end faces 14 16 which may be at right angles to one another which are intended to be located in face to face contact with the floor and wall respectively of the caravan, boat, portable building or the like in which the main is to be installed, and a third face 12 which in the illustration extends generally at 45 deg. to the other two faces. The formation includes a web 18 for location in a slot in the floor (or ceiling) for fixing the extrusion in place.

It will be noted that the surface 12 extends beyond both of the end faces 14, 16 to provide a pair of wings 20 22 defined by flat faces co-planar and co-extensive with the flat face 12 and having rear faces 24 26 which project through planes containing the respective faces 14 and 16.

The extrusion is made with a pair of continuously extending channels 30 which in this embodiment are of generally rectangular shape, and slots 32 open from the channels through the said flat face 12.

The slots extend from a minor dimension of the rectangular channel shape. Preferably the extrusion includes surfaces which abut so that the slot is normally closed over the portion of the same extending between the channel and a Vee entry to the slot, so that as manufactured and as illustrated, the slots are of near zero width, but by flexing the wings in the directions A, gaps may be opened up permitting the wire conductors 34, 36 to be positioned in the channels by lateral movement relative to the length of the conductors and passing them through those gaps. This is necessary when the extrusion is made in very long lengths, although it would be possible with shorter lengths to feed the conductor to the channels axially. However, even where the conductors are fed in axially, the slots are present in order to enable connections to be made, and those slots are normally closed along their length.

In this embodiment the conductors are of metal strip of somewhat C cross section so as to occupy the whole of one dimension of the channels (the major dimension of the rectangular shape) but not the whole of a second dimension at right angles thereto.

Figure 2:
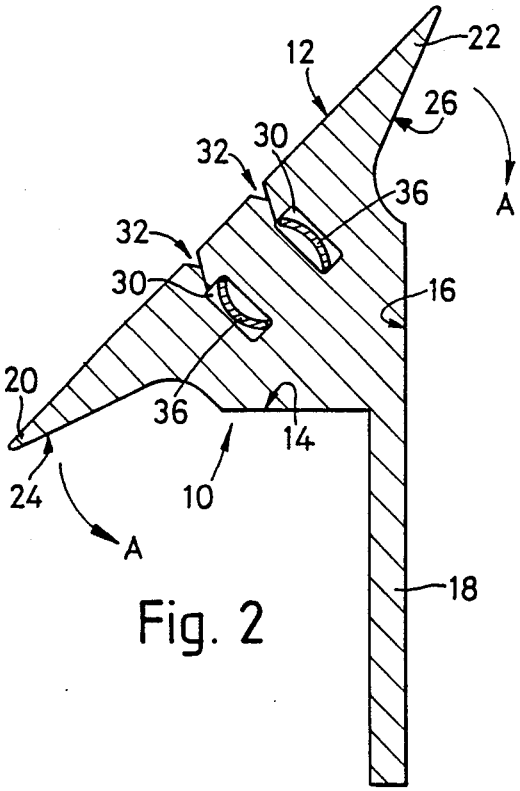
FIG. 2 is an enlarged section on the line 2 2 of FIG. 1 showing the construction of the main conductor itself prior to installation.

The main may be laid in place where required and it is intended that the wings 20 22 should be deflected so that the rear faces 24 26 become co-planar with the faces 14 16, as shown in broken line in FIG. 2 and this has the effect of urging the faces closer together to hold the slots tightly closed. In addition, the face 12 then provides a gently contoured fairing between the wall and floor or wall and ceiling where the main is laid.

The invention is primarily intended for low voltage use, which means up to 50 volts. In practice, e.g. for a 12 or 24 volt installation, the extrusion may be of the order of 15 mm wide on the floor and wall faces and some 22 mm wide on the face 12 and then the wires may be of the order of 3 mm wide. It will be found (depending upon materials employed) that they can be bent by hand around gentle contours, and by appropriate bending tool round smaller radii.

Figure 5:
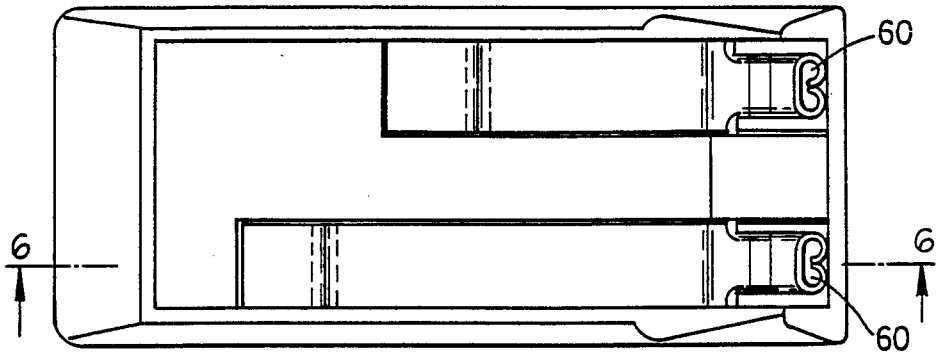
FIG. 5 is a plan view of the branch connector on the same scale as FIG. 4 with a cover part removed for clarity.
Figure 6:
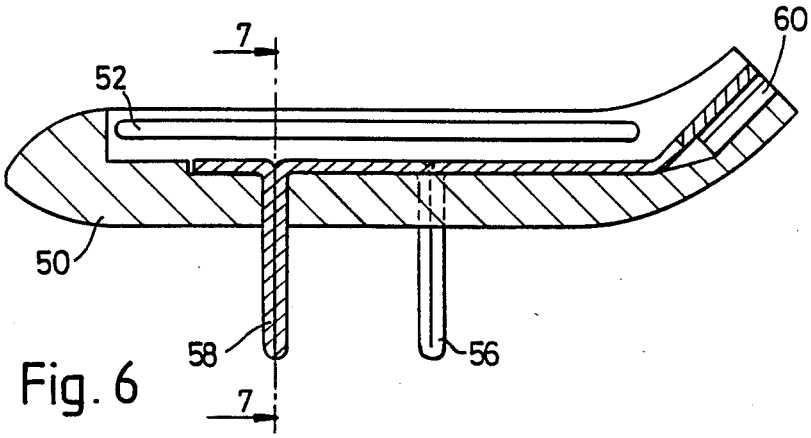
FIG. 6 is a section on the line 6 6 of FIG. 5.
Figure 7:
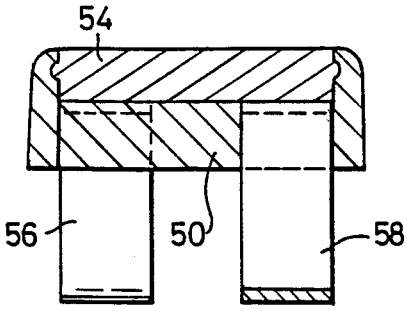
FIG. 7 is a section on the line 7 7 of FIG. 6.

The branch connector or electric plug shown for example in FIGS. 5 to 7 may be made of two parts namely the base part 50 having a channel in its upper face provided with shallow grooves 52 in the sides of the channel and with a snap-in separate lid part 54. Alternatively, a part of similar area to the lid part may be hinged at one end of the part 50 so as to be snap-engaged or secured by adhesive after the necessary conductors have been assembled into the base part 50.

FIG. 5 shows the location of a pair of terminals each made from a length of sheet metal folded and crimped into a Tee shape so that the stem of the Tee provides a terminal prong 56 58, the prongs being separated and spaced by channels in the base formation. The prongs are at different spacings along the length of the base part 50 so that the plug can be generally at right angles to the strip in use. At one end the prongs are provided with a generally tubular formation 60 apt to be crimped to wire conductors.

Figure 3:
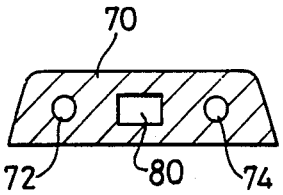
FIG. 3 is an enlarged section on the line 3 3 showing the branch conductor.
Figure 4:
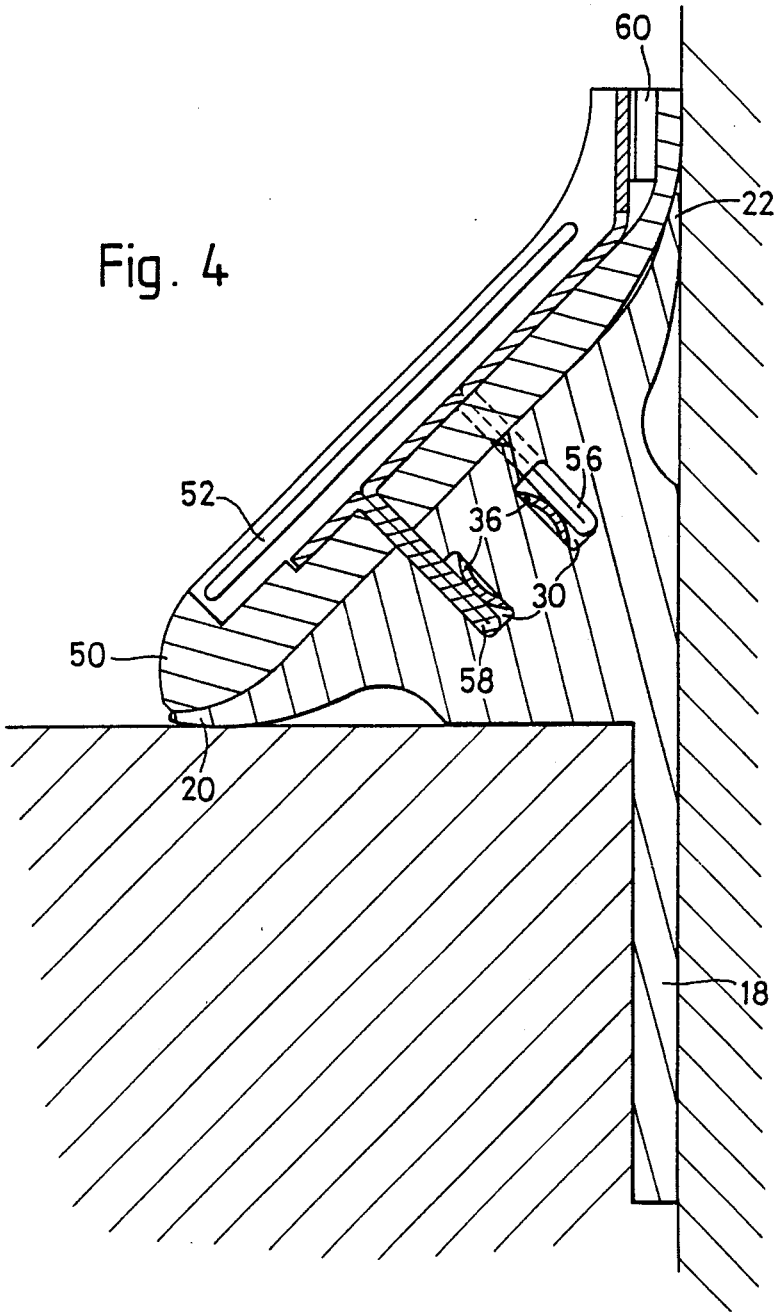
FIG. 4 is a further enlarged section on the line 4 4 of FIG. 1 showing the installed main and the branch connector.

The branch conductor, as seen in FIG. 3 may comprise an extrusion 70 encasing a pair of conductors 72 74, that is to say moulded about them. The extrusion 70 may include one or more voids 80 to save material, and such a void in the illustrated position is convenient for fixing pins or the like to attach the cable to a wall. The void reduces the resistance to passage of the pin and enables deformation of the extrusion to enable the pin head to be flush with the outer face. To make the connection between the conductors 72 74 and the tubular portions 60, an end portion of the insulator 70 is stripped from the conductors and then the latter are crimped into the tubular formation 60 to be enclosed between the base 50 and the lid 54. The branch conductor is connected to the main by placing the free ends of the prongs 56 58 in line with the slots, and it will be noted from FIG. 4 that each slot opens to a Vee section recess at the face 12 to facilitate such alignment. The prongs are then simply pushed home to enter the channels between the convex face of each conductor and the adjacent channel wall face. They are held in place by the frictional grip of the material and any resilience which it may possess, that is to say the slots are forced open by the prongs, but only in the vicinity of the prongs. Elsewhere they remain closed.

I claim:

1. A wiring system comprising an elongate body of generally triangular cross section, said body having a pair of end faces occupying substantially normal planes and a third face spanning said end faces, said body being formed of flexible, resilient, insulating material having therein a pair of longitudinally extending, parallel channels, an elongate electrical conductor accommodated in each of said channels and occupying a position within said body spaced inwardly from all faces of said body, said body having a pair of elongate, parallel slots therein, each of said slots extending inwardly from said third face of said body in communication with a respective one of said channels to enable access to the respective conductors at any selected point along the length of said body, said slots normally being closed but the resilience of the material forming said body enabling each of slots to be opened sufficiently in response to deflection in one direction of said body to accommodate an electrically conductive member movable into and out of the respective slot.

2. A system as claimed in claim 1 wherein said body has a wing extension at opposite ends of said third face and between which said channels extend, said extensions being operable to deflect said body and facilitate opening of said slots.

3. A system as claimed in claim 2 wherein said extensions are operable when said body is installed on a support to apply a force on said body tending to close said slots.

4. A system as claimed in claim 1 wherein each of said channels is defined by walls, and wherein the conductors are of such shape and dimensions relative to the channels to provide in each channel a gap between one channel wall and the respective conductor.

5. A system as claimed in claim 4 wherein each said channel is generally rectangular in cross section and said conductor is C shaped in cross section.

6. A system as claimed in any preceding claim wherein each slot communicates with its respective channel through a pair of abutting surfaces and a Vee section groove.

7. A system as claimed in any of claims 1 through 5 including an outlet having an insulating member provided with a pair of conductive prongs adapted for removable accommodation in the respective channels in engagement with the respective conductors, the prongs extending from the member in the same direction but at different locations relative to both length and width of the member.

8. A system as claimed in claim 7 wherein each of said prongs comprises a strip of flat sheet metal provided at one end with a connector for a branch conductor and having its other end pressed and crimped into a Tee formation having a stem forming the prong itself.

9. An electrical outlet socket construction comprising an elongate body formed of yieldable, resilient, insulating material, said body being generally triangular in cross section and having three faces two of which are end faces occupying planes substantially normal to one another, the third face of said body extending beyond both of said end faces to form wings at opposite ends of said third face, a pair of spaced apart, parallel channels in said body between said wings and extending longitudinally of said body, each of said channels being in communication with the third face of said body via a normally closed slot, an elongate electrical conductor occupying each of said channels and extending longitudinally of said body, the yieldability of the material from which said body is formed enabling said slots to be opened at any selected point along the length of said body in response to rocking of said wings from a normal position in a direction toward the respective end faces and more tightly closed in response to rocking of said wings from said normal position in the opposite direction.

* * * * *